US011795631B2

(12) United States Patent
Wehrenberg et al.

(10) Patent No.: US 11,795,631 B2
(45) Date of Patent: Oct. 24, 2023

(54) LINKAGE SYSTEM FOR SCREED EXTENSION

(71) Applicant: Caterpillar Paving Products Inc., Brooklyn Park, MN (US)

(72) Inventors: Timothy L Wehrenberg, Maple Grove, MN (US); Toby Frelich, Saint Michael, MN (US); Brad W Green, Siler City, NC (US); Ryan Thiesse, Otsego, MN (US)

( * ) Notice: Subject to any disclaimer, the term of this patent is extended or adjusted under 35 U.S.C. 154(b) by 304 days.

(21) Appl. No.: 17/354,741

(22) Filed: Jun. 22, 2021

(65) Prior Publication Data

US 2022/0403608 A1 Dec. 22, 2022

(51) Int. Cl.
*E01C 19/42* (2006.01)
*E01C 19/48* (2006.01)

(52) U.S. Cl.
CPC ..... *E01C 19/42* (2013.01); *E01C 19/4873* (2013.01); *E01C 2301/16* (2013.01)

(58) Field of Classification Search
CPC ... E01C 19/42; E01C 19/4873; E01C 2301/16
USPC ..... 404/72–75, 118
See application file for complete search history.

(56) References Cited

U.S. PATENT DOCUMENTS 3,557,672 A * 1/1971 Shurtz ..... E01C 19/4873 404/95
4,259,794 A 4/1981 Rath
4,453,773 A 6/1984 Toffolon
5,427,470 A 6/1995 McKim
5,924,819 A * 7/1999 Breidenbach ..... E01C 19/42 404/96
6,056,474 A 5/2000 Nolan
6,238,134 B1 * 5/2001 Sovik ..... E01C 19/4893 404/87
6,890,125 B1 5/2005 Calder et al.
8,221,026 B2 7/2012 Munz et al.
9,045,871 B2 6/2015 Graham et al.
9,200,415 B2 12/2015 Graham et al.
9,222,227 B2 12/2015 Kopacz et al.
9,624,627 B2 4/2017 Wang
10,744,909 B2 8/2020 Kong et al.
(Continued)

FOREIGN PATENT DOCUMENTS

CN 102477714 A 5/2012
CN 102926312 A 2/2013
(Continued)

*Primary Examiner* — Raymond W Addie
(74) *Attorney, Agent, or Firm* — Harrity & Harrity LLP

(57) ABSTRACT

A linkage system for a screed extension includes a mounting plate that includes a mounting plate finger; an upper rail; a lower rail; a height adjustment shaft; a set of slide blocks that are disposed in a channel between the upper rail and the lower rail; a set of linkage arms; an angle of attack adjustment structure that holds the mounting plate finger at an angle; and a set of angle of attack adjustment screws. The height adjustment shaft is configured to adjust a position of the set of slide blocks within the channel and thereby adjust a height of a lower frame of the screed extension. The set of angle of attack adjustment screws are configured adjust the angle of the mounting plate finger and thereby adjust an angle of attack of the lower frame of the screed extension.

20 Claims, 14 Drawing Sheets

(56) References Cited

U.S. PATENT DOCUMENTS

| | | | | |
|---|---|---|---|---|
| 10,844,556 | B2 | 11/2020 | Wehrenberg et al. | |
| 2002/0110419 | A1* | 8/2002 | Batty | E01C 19/48 404/84.1 |
| 2007/0258769 | A1* | 11/2007 | Eppes | E01C 19/48 404/118 |
| 2008/0111914 | A1* | 5/2008 | Takahashi | H04N 5/222 348/E5.025 |
| 2010/0150651 | A1* | 6/2010 | Buschmann | E01C 19/48 404/82 |
| 2010/0209190 | A1* | 8/2010 | Munz | E01C 19/48 404/118 |
| 2013/0082508 | A1 | 4/2013 | Orefice | |
| 2013/0253780 | A1* | 9/2013 | Smieja | E01C 19/48 701/50 |
| 2013/0294833 | A1* | 11/2013 | Engel | E01C 19/48 404/118 |

FOREIGN PATENT DOCUMENTS

| | | | |
|---|---|---|---|
| CN | 204282173 | U | 4/2015 |
| CN | 207376412 | U | 5/2018 |
| DE | 4229465 | A1 | 3/1994 |
| GB | 830445 | A | 3/1960 |

* cited by examiner

400

LINKAGE SYSTEM FOR SCREED EXTENSION

TECHNICAL FIELD

The present disclosure relates generally to a screed extension of a screed assembly and, for example, to a linkage system for the screed extension.

BACKGROUND

Paving machines (also referred to as road pavers) are commonly used to apply, spread, and/or compact a paving material mat (e.g., a mat of bituminous roadway material) relatively evenly over a work surface. These machines are generally used in the construction of roads, parking lots, and other areas. A typical paving machine employs a screed assembly (sometimes referred to as a floating screed) to lay the paving material mat. The screed assembly may include one or more sections, such as a primary screed and one or more screed extensions respectively attached to an end of the primary screed. Each section may be involved in laying a paving material mat. In many cases, a uniform paving material mat (e.g., that has a uniform texture, a uniform height, and/or a uniform density, among other examples) is desired. This often requires, however, for each section of the screed assembly to have a different configuration, such as in terms of screed height and angle of attack.

One attempt to provide an adjusting mechanism for a screed for a paver is disclosed in China Utility Model Patent No. CN204282173U (the '173 patent). Per the '173 patent, the screed comprises a main section and a telescopic plate telescopic relative to the main section, wherein a plate frame is arranged on the telescopic plate, and further comprises an adjusting rod, a first connecting rod and a second connecting rod. The two ends of the first connecting rod are hinged to the first side part of the adjusting rod and the telescopic plate and the two ends of the second connecting rod are hinged to the second side part of the adjusting rod and the telescopic plate. The length of the adjusting rod from the first side part to the second side part is adjustable, the adjusting rod is attached to the plate frame, and the adjusting rod is also connected with an adjusting mechanism for horizontally moving the whole adjusting rod. Further, the '173 patent discloses that the adjusting rod can be driven to adjust the height up and down of the screed and can be horizontally moved to adjust the elevation angle of the screed.

However, continual use of the adjustment rod to adjust height and elevation angle affects a relative position and orientation angle of the first connecting rod and the second connecting rod over time. This causes the height and the elevation angle of the screed to be nonuniformly adjusted across the screed when the adjustment rod is driven and/or horizontally moved, which can affect a quality of the paving material mat when laid by the screed (e.g., cause a non-uniform paving material mat to be laid). Further, the '173 patent does not disclose a pivot pin, a guide pin, or any other component to ensure accurate adjustment of height and/or elevation angle of the screed over an operating life of the adjusting mechanism. The system of the present disclosure solves one or more of the problems set forth above and/or other problems in the art.

SUMMARY

In some implementations, a paving machine includes a linkage system that is included in a screed extension of a screed assembly of the paving machine, wherein the linkage system includes: a mounting plate that includes a mounting plate finger; an upper rail that is attached to the mounting plate; a lower rail that is attached to the mounting plate; a height adjustment shaft; a set of slide blocks that are disposed in a channel between the upper rail and the lower rail, wherein each slide block, of the set of slide blocks, includes a shaft hole that holds a portion of the height adjustment shaft within the slide block; a set of linkage arms, wherein each linkage arm, of the set of linkage arms, includes a first end that is attached to a corresponding slide block, of the set of slide blocks, and a second end that is attached to the lower frame of the screed extension; an angle of attack adjustment structure that holds the mounting plate finger at an angle relative to an axis associated with the angle of attack adjustment structure; and a set of angle of attack adjustment screws, wherein: the height adjustment shaft is configured to rotate about a longitudinal axis of the height adjustment shaft to adjust a position of the set of slide blocks within the channel, wherein adjusting the position of the set of slide blocks within the channel causes adjustment of a height of the lower frame of the screed extension; and each angle of attack adjustment screw, of the set of angle of attack adjustment screws, is configured to rotate about a longitudinal axis of the angle of attack adjustment screw to adjust the angle of the mounting plate finger within the angle of attack adjustment structure, wherein adjusting the angle of the mounting plate finger within the angle of attack adjustment structure causes adjustment of an angle of attack of the lower frame of the screed extension.

In some implementations, a screed extension includes a linkage system that includes: a mounting plate that includes a mounting plate finger; an upper rail that is attached to the mounting plate; a lower rail that is attached to the mounting plate; a height adjustment shaft; a set of slide blocks that are disposed in a channel between the upper rail and the lower rail, wherein each slide block, of the set of slide blocks, includes a shaft hole that holds a portion of the height adjustment shaft within the slide block; a set of linkage arms, wherein each linkage arm, of the set of linkage arms, includes a first end that is attached to a corresponding slide block, of the set of slide blocks, and a second end that is attached to a lower frame of the screed extension; an angle of attack adjustment structure that holds the mounting plate finger at an angle relative to an axis associated with the angle of attack adjustment structure; and a set of angle of attack adjustment screws.

In some implementations, a linkage system includes a mounting plate that includes a mounting plate finger; an upper rail that is configured to attach to the mounting plate; a lower rail that is configured to attach to the mounting plate; a height adjustment shaft; a set of slide blocks that are configured to be disposed in a channel between the upper rail and the lower rail, wherein each slide block, of the set of slide blocks, includes a shaft hole that is configured to hold a portion of the height adjustment shaft within the slide block; a set of linkage arms, wherein each linkage arm, of the set of linkage arms, includes a first end that is configured to attach to a corresponding slide block, of the set of slide blocks, and a second end that is configured to attach to a lower frame of a screed extension; an angle of attack adjustment structure that is configured to hold the mounting plate finger at an angle relative to an axis associated with the angle of attack adjustment structure; and a set of angle of attack adjustment screws.

DETAILED DESCRIPTION

This disclosure relates to a linkage system for a screed extension, which is applicable to any machine that utilizes a screed extension (e.g., with a primary screed). For example, the machine may be a paving machine, such as a road paver, or an asphalt finisher, among other examples.

Figure 1A:
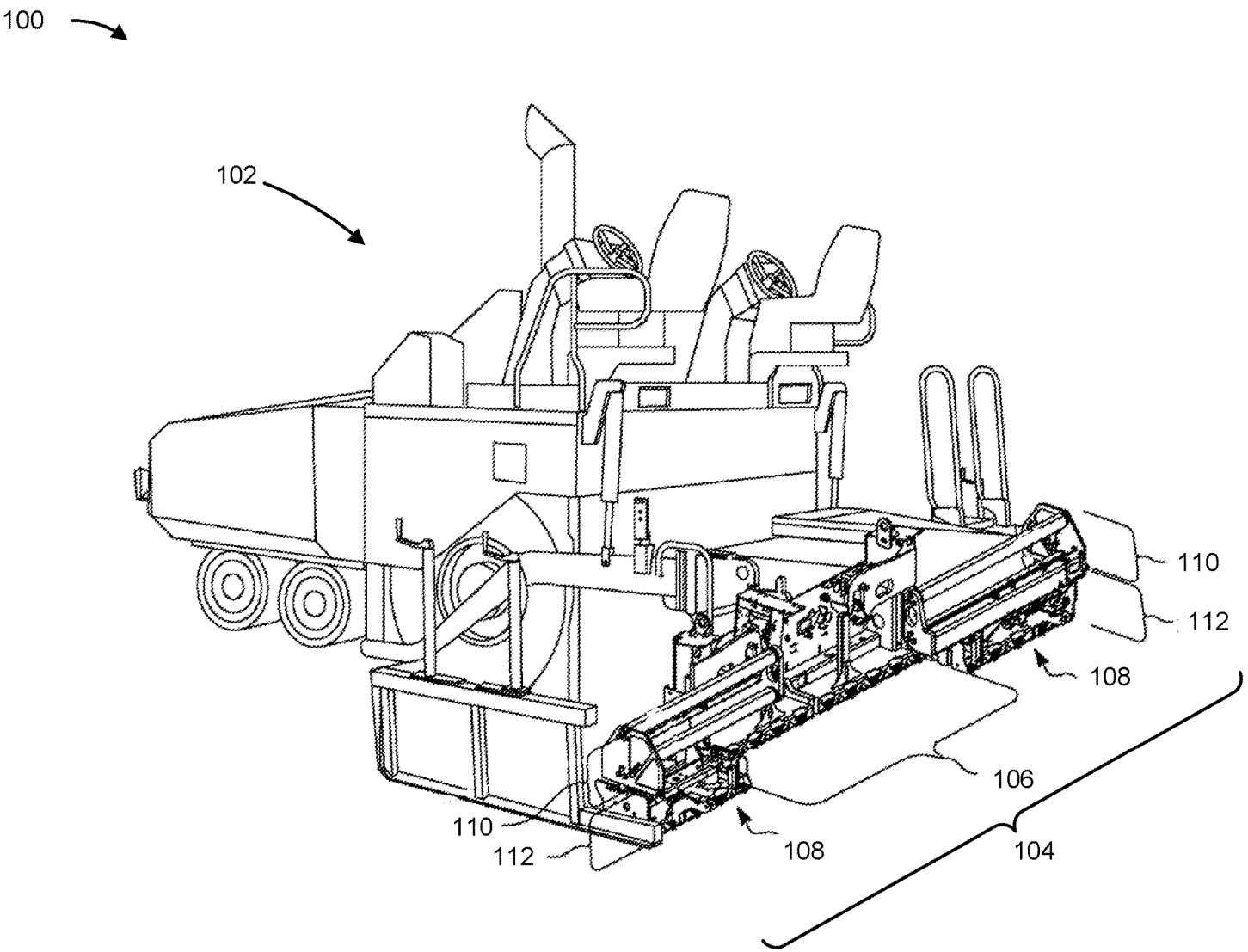
FIGS. 1A-1C are diagrams relating to an example paving machine that includes a screed assembly described herein.
Figure 1B:
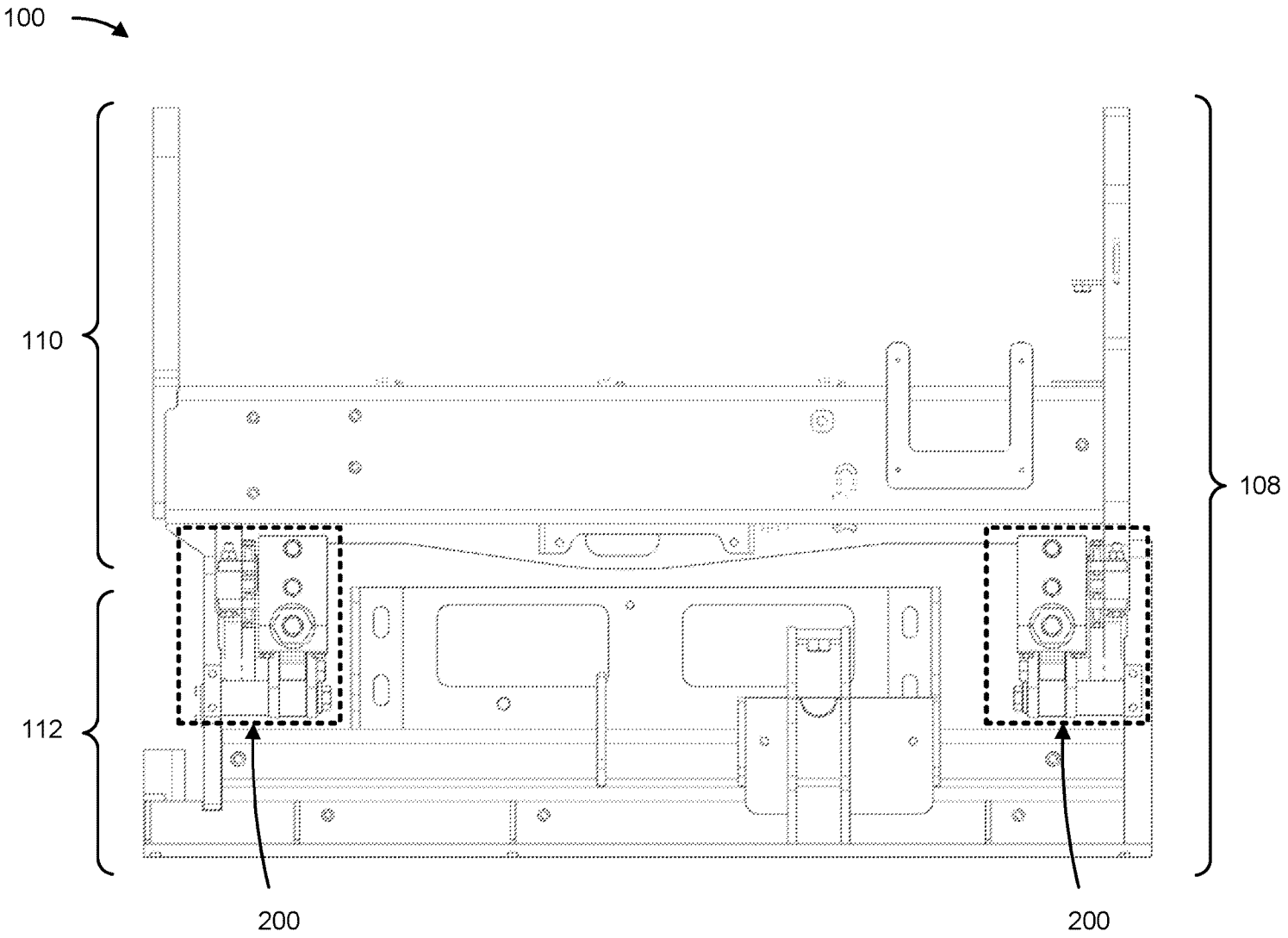
Figure 1C:
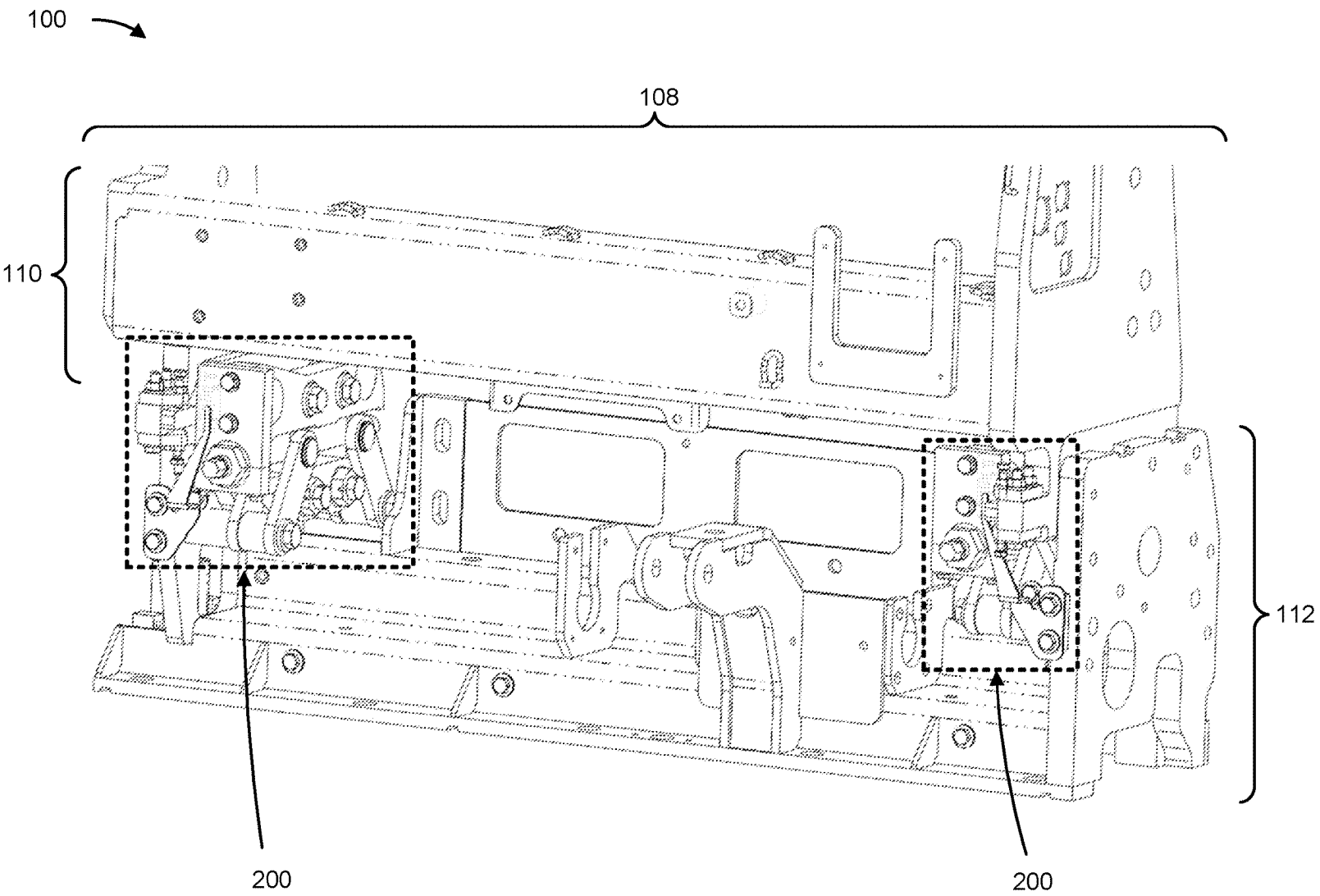

FIGS. 1A-1C are diagrams 100 relating to an example paving machine 102 that includes a screed assembly 104. The paving machine 102 may be a road paver, an asphalt finisher, or a similar machine. As shown in FIG. 1A, the screed assembly 104 may include a primary screed 106 and a pair of screed extensions 108 (e.g., that are disposed on opposite sides of the primary screed 106). Each screed extension 108 may be moveably coupled to the primary screed 106. FIG. 1B shows a front view of a screed extension 108 (e.g., a view of a side of the screed extension 108 that faces the paving machine 102). FIG. 1C shows an angled front view of the screed extension 108.

As shown in FIGS. 1A-1C, the screed extension 108 includes an upper frame 110 and a lower frame 112. As further shown in FIG. 1B-1C, a set of linkage systems 200 (shown as a left linkage system 200 and a right linkage system 200 in FIGS. 1A-1B) may be used to connect the upper frame 110 and the lower frame 112. The set of linkage systems 200 may be adjusted to control a height of the lower frame 112 (e.g., a distance between a lower edge of the lower frame 112 and a work surface underneath the lower edge of the lower frame 112) and/or an angle of attack of the lower frame 112 (e.g., an angle a screed plate that attaches to the lower edge of the lower frame 112 makes when contacting the work surface). An example linkage system 200 is further described herein in relation to FIGS. 2A-2D.

As indicated above, FIGS. 1A-1C are provided as an example. Other examples may differ from what is described in connection with FIGS. 1A-1C.

Figure 2A:
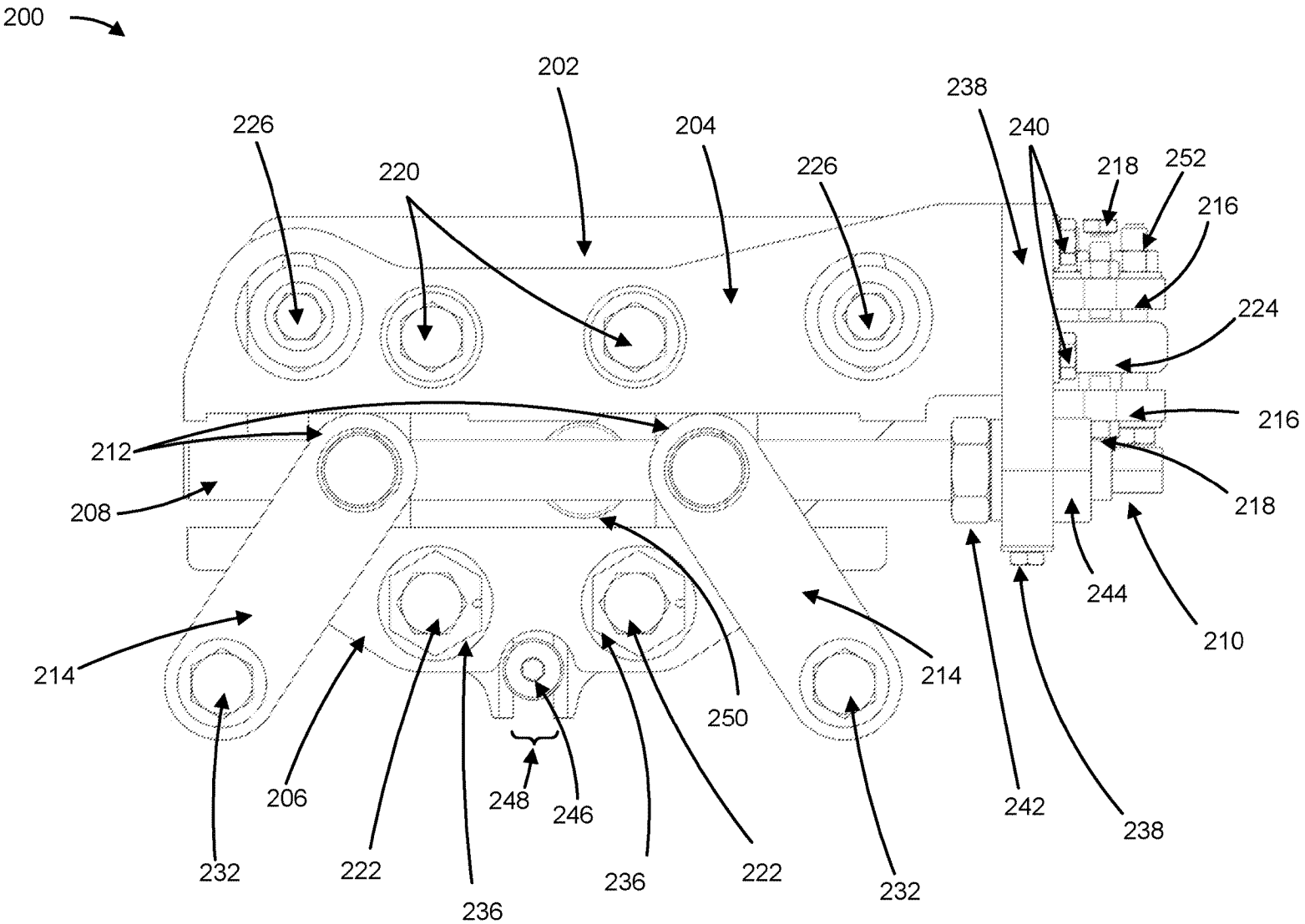
FIGS. 2A-2D are diagrams of an example linkage system described herein.
Figure 2B:
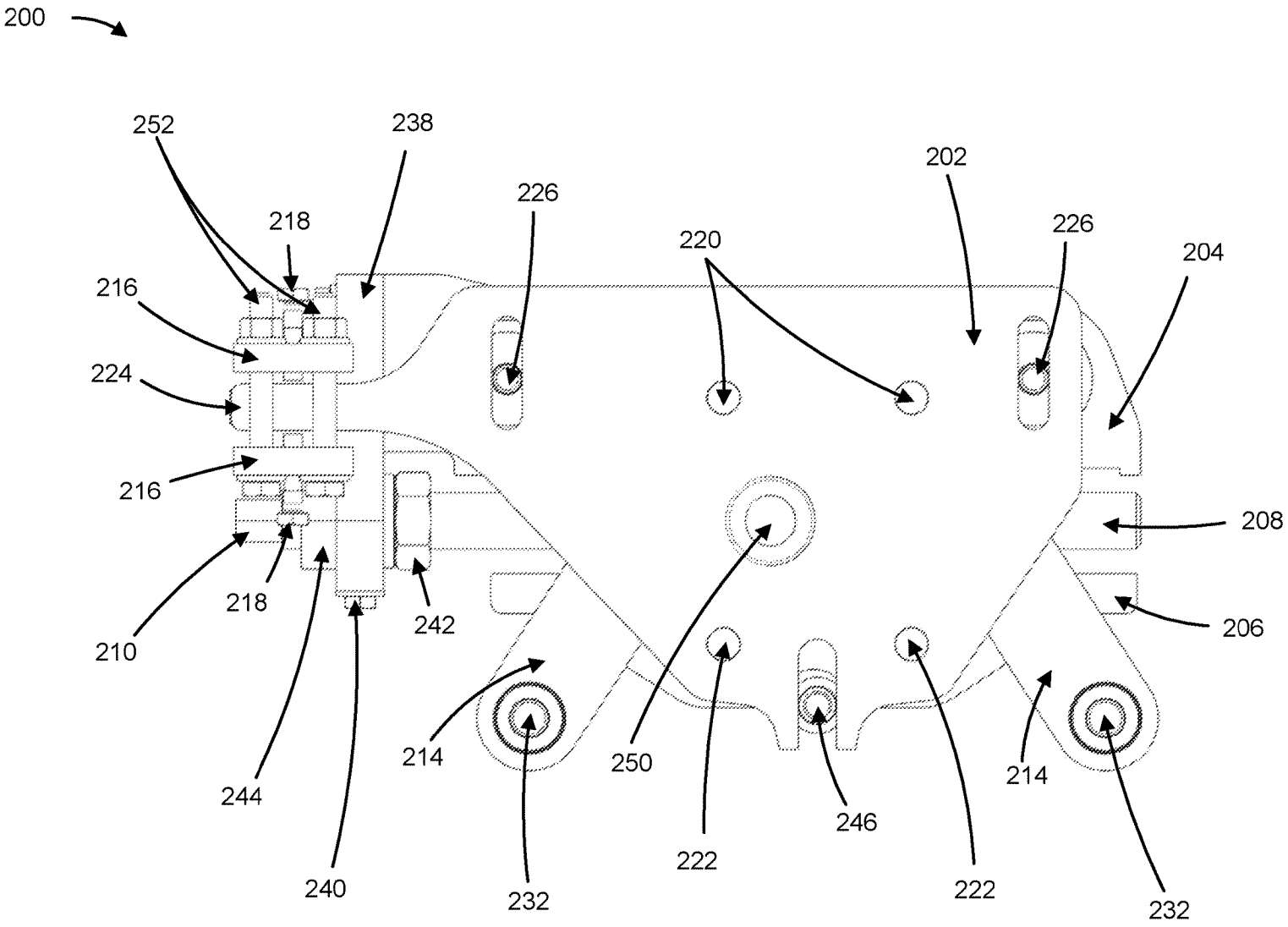
Figure 2C:
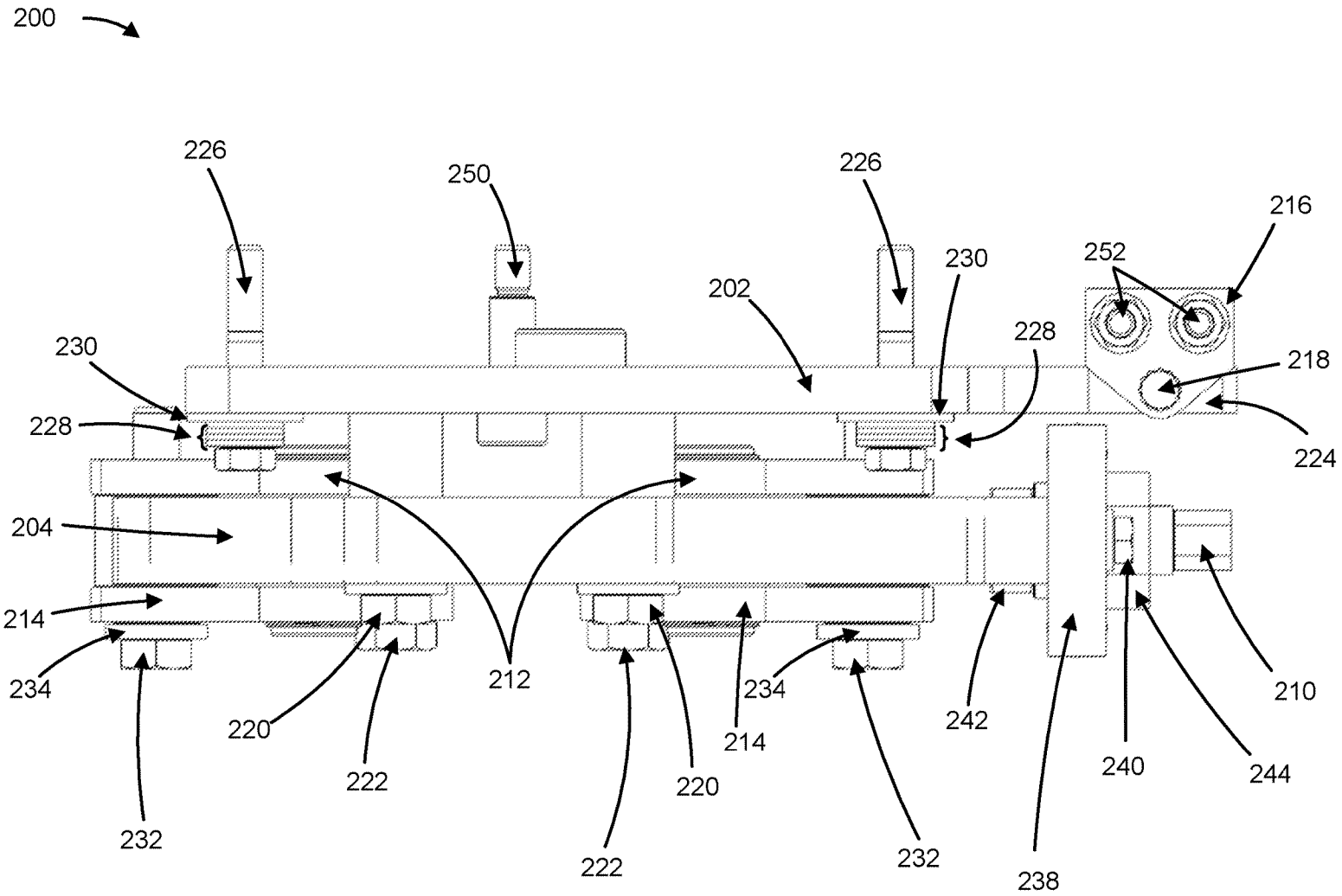
Figure 2D:
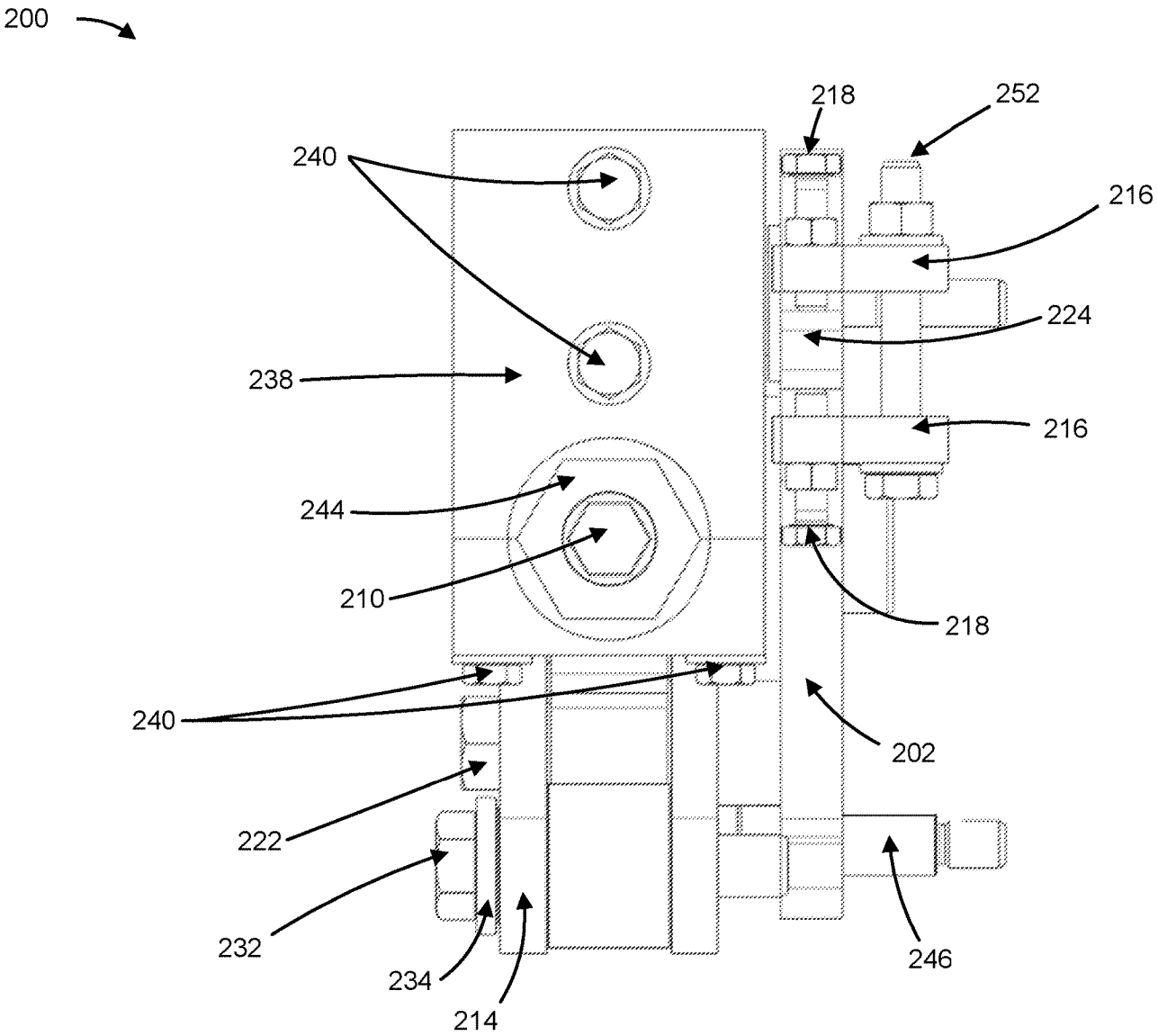

FIGS. 2A-2D are diagrams of the example linkage system 200 described herein. FIG. 2A shows a front view of the linkage system 200; FIG. 2B shows a back view of the linkage system 200; FIG. 2C shows a top view of the linkage system 200; and FIG. 2D shows a side view (e.g., a right side view) of the linkage system 200. As described above, the linkage system 200 may be included in the screed extension 108. As shown in FIGS. 2A-2D, the linkage system 200 includes a mounting plate 202, an upper rail 204, a lower rail 206, a height adjustment shaft 208 that includes an engagement end 210, a set of slide blocks 212, a set of linkage arms 214, an angle of attack adjustment structure 216, and/or a set of angle of attack adjustment screws 218.

The mounting plate 202 is configured to provide structural support to one or more components of the linkage system 200. For example, as shown in FIGS. 2A-2D, the mounting plate 202 may be attached to the upper rail 204 via a set of bolts 220 and/or may be attached to the lower rail 206 via a set of bolts 222. As further shown in FIGS. 2A-2D, the mounting plate 202 may include a mounting plate finger 224 (e.g., the mounting plate finger 224 may be a monolithic component of the mounting plate 202). The mounting plate finger 224 may be held by the angle of attack adjustment structure 216 and/or the set of angle of attack adjustment screws 218, as further described herein.

As shown in FIGS. 2A-2C, the mounting plate 202 is configured to attach to the lower frame 112 of the screed extension 108 via a set of bolts 226. As further shown in FIG. 2C, a bolt 226, of the set of bolts 226 may be inserted into a set of spring washers 228, a washer 230, and a slot of the mounting plate 202. When the linkage system is installed in the screed extension 108, the bolt 226 may be further inserted in a slot of the upper frame 110 and a bore of the lower frame 112 of the screed extension 108. In this way, the bolt 226 secures attachment of the mounting plate 202 to the lower frame 112 of the screed extension 108. In this way, the washer 230 may be disposed on a surface of the mounting plate 202 and the set of spring washers 228 may be disposed between the washer 230 and a head of the bolt 226. In some implementations, just the washer 230 or just the set of spring washers may be disposed between the surface of the mounting plate 202 and the head of the bolt 226.

The set of linkage arms 214 may be configured to attach the linkage system 200 to the lower frame 112 of the screed extension 108. For example, as shown in FIGS. 2A-2C, respective ends of the set of linkage arms 214 may be attached to the lower frame 112 of the screed extension 108 via a set of bolts 232. As further shown in FIGS. 2C-2D, a bolt 232, of the set of bolts 232 may be inserted into a washer 234, a bore of an end of a linkage arm 214, and a bore of the lower frame 112 of the screed extension 108 to secure attachment of the linkage arm 214 to the lower frame 112 of the screed extension 108. In this way, the washer 234 may be disposed between a surface of the linkage arm 214 and a head of the bolt 232.

The set of slide blocks 212 are disposed between the upper rail 204 and the lower rail 206. For example, as shown in FIGS. 2A and 2C, the set of slide blocks 212 (shown as a left slide block 212 and a right slide block 212 in FIGS. 2A and 2C) may be disposed in a channel between the upper rail 204 and the lower rail 206. The set of slide blocks 212 may be configured to move (e.g., slide) within the channel (e.g., horizontally within the channel).

In some implementations, the linkage system 200 may include a set of eccentric adjusters 236 that cause the lower rail 206 and the upper rail 204 to exert a clamping force on the set of slide blocks 212 within the channel. For example, an eccentric adjuster 236, of the set of eccentric adjusters, may be inserted into a bore of the lower rail 206. When assembling the linkage system 200, the upper rail 204 may be attached to the mounting plate 202 (e.g., with the set of bolts 220, as described herein), the set of slide blocks 212 may be inserted into the channel formed between the upper rail 204 and the lower rail 206, and the lower rail 206 may be attached to the mounting plate 202 using the set of eccentric adjusters 236 to cause the lower rail 206 to be placed in a position, relative to the upper rail 204, that causes the lower rail 206 and the upper rail 204 to exert a clamping force on the set of slide blocks 212 within the channel. Additionally, or alternatively, the set of eccentric adjusters 236 may respectively include holes for the set of bolts 222 to securely attach the lower rail 206 to the mounting plate 202. For example, as shown in FIG. 2A, a bolt 222, of the set of bolts 222, may be inserted into a hole of an eccentric adjuster 236, of the set of eccentric adjusters 236, the bore of the lower rail 206, and the bore of the mounting plate 202 to securely attach the lower rail 206 to the mounting plate 202.

A slide block 212, of the set of slide blocks 212, includes a shaft hole that holds a portion of the height adjustment shaft 208 within the slide block 212. Accordingly, as shown in FIG. 2A, the set of slide blocks 212 may hold the height adjustment shaft 208 within the channel disposed between the upper rail 204 and the lower rail 206. The height adjustment shaft 208 may be threaded and the shaft hole of each of the set of slide blocks 212 may be threaded such that when the height adjustment shaft 208 is rotated (e.g., about a longitudinal axis of the height adjustment shaft 208) the set of slide blocks 212 move (e.g., horizontally move) within the channel. For example, the height adjustment shaft 208 may be threaded in a particular orientation (e.g., a clockwise orientation), a first slide block 212, of the set of slide blocks 212, may include a first shaft hole that is threaded in the particular orientation, and a second slide block 212, of the set of slide blocks 212, may include a second shaft hole that is threaded in an opposite orientation of the particular orientation (e.g., threaded in a counter-clockwise orientation). Accordingly, the height adjustment shaft 208 may be configured to cause, when rotated (e.g., about the longitudinal axis of the height adjustment shaft 208), the first slide block 212 to move in a first direction within the channel and cause the second slide block 212 to move in a second direction within the channel (e.g., a second direction that is approximately opposite of the first direction). For example, the height adjustment shaft 208 may cause the first slide block 212 to move left and the second slide block 212 to move right within the channel when the height adjustment shaft 208 is rotated clockwise and may cause the first slide block 212 to move right and the second slide block 212 to move left within the channel when the height adjustment shaft 208 is rotated counter-clockwise.

The set of linkage arms 214 are respectively attached to the set of slide blocks 212. For example, as shown in FIGS. 2A and 2C, an end of a linkage arm 214, of the set of linkage arms 214, may be attached to a slide block 212 of the set of slide blocks 212 (e.g., as further described herein in relation to FIG. 3A). As shown in FIG. 2A, the set of linkage arms 214 may be attached to the set of slide blocks 212 at an approximately symmetrical angle (e.g., in relation to a vertical axis). The set of linkage arms 214 may be configured to cause a force to be exerted on the linkage system 200 and thereby cause a separation force to be exerted on the upper frame 110 and the lower frame 112 of the screed extension 108. When the position of the set of slide blocks 212 is adjusted (e.g., as described above), a position of the set of linkage arms 214 is adjusted, which causes a height of the lower frame 112 to be adjusted (e.g., in relation to a work surface). Further description regarding adjustment of the height of the lower frame 112 is described herein in relation to FIGS. 4A-4B.

In some implementations, the linkage system 200 may include a height adjustment structure 238 that is attached to the upper rail 204. For example, as shown in FIGS. 2A-2D, the height adjustment structure may be attached to the upper rail 204 via a set of bolts 240. The height adjustment structure 238 may include a hole that is configured to hold the height adjustment shaft 208 (e.g., to cause the height adjustment shaft 208 to be securely held within the chamber formed by the upper rail 204 and the lower rail 206 and within the set of slide blocks 212). The height adjustment shaft 208 may be inserted into a height adjustment jam nut 242 (e.g., that is disposed between the height adjustment structure 238 and the chamber formed by the upper rail 204 and the lower rail 206), the hole of the height adjustment structure 238, and a height adjustment screw nut 244 (e.g., that is disposed on a surface of the height adjustment structure 238). The height adjustment jam nut 242 and the height adjustment screw nut 244 may cause the height adjustment shaft 208 to be "locked" within the hole of the height adjustment structure 238, such that that lateral movement (e.g., horizontal movement) of the height adjustment shaft 208 is prevented, but rotation (e.g., about the longitudinal axis of the height adjustment shaft 208) of the height adjustment shaft 208 is allowed.

As further shown in FIGS. 2A-2D, the engagement end 210 of the height adjustment shaft 208 may be positioned at an end of the height adjustment shaft 208 (e.g., that extends beyond an end of the height adjustment structure 238). The engagement end 210 may be configured to rotate to cause the height adjustment shaft 208 to rotate (e.g., about the longitudinal axis of the height adjustment shaft 208). For example, an operator of the screed extension 108 may use a wrench or other tool to engage the engagement end 210 to cause the height adjustment shaft 208 to rotate, which may cause the set of slide blocks 212 to move (e.g., adjust a position of the set of slide blocks 212 within the channel), which may cause adjustment of a height of the lower frame of the screed extension 108.

In some implementations, a guide pin 246 is attached to the lower frame 112 of the screed extension 108. For example, as shown in FIGS. 2A-2B and 2D, the guide pin 246 may be attached to the lower frame 112 in a position that is between (e.g., in a lateral, horizontal direction) the set of bolts 232 (e.g., that attach the set of linkage arms 214 to the lower frame 112 of the screed extension 108). Further, the guide pin 246 may engage with a slot 248 of the mounting plate 202 and may be configured to maintain an approximately symmetrical angle of attachment of the set of linkage arms 214 to the set of slide blocks 212 (e.g., as described above) when the position of the set of slide blocks 212 is adjusted (e.g., by rotation of the height adjustment shaft 208). Further description regarding the symmetrical angle of attachment of the set of linkage arms 214 is provided with respect to FIGS. 4A-4B.

The angle of attack adjustment structure 216 is configured to hold the mounting plate finger 224. The angle of attack adjustment structure 216 may hold the mounting plate finger 224 at an angle relative to an axis (e.g., a horizontal axis) associated with the angle of attack adjustment structure 216. In some implementations, the angle of attack adjustment structure 216 may include the set of angle of attack adjustment screws 218, which are configured to hold the mounting plate finger 224 (e.g., a first angle of attack adjustment screw 218 and a second angle of attack adjustment screw 218 may contact the mounting plate finger 224 to exert a clamping force on the mounting plate finger 224) at the angle within the angle of attack adjustment structure 216.

An angle of attack adjustment screw 218, of the set of angle of attack adjustment screws 218, may be configured to rotate (e.g., about a longitudinal axis of the angle of attack adjustment screw 218) to adjust the angle of the mounting plate finger 224 within the angle of attack adjustment structure 216. For example, as shown in FIG. 2C, a bottom angle of attack adjustment screw 218 and/or a top angle of attack adjustment screw 218 may be rotated downward to cause an angle of the mounting plate finger 224 to adjust downward and/or the bottom angle of attack adjustment screw 218 and/or the top angle of attack adjustment screw 218 may be rotated upward to cause an angle of the mounting plate finger 224 to adjust upward.

In some implementations, the linkage system 200 includes a pivot pin 250 that attaches the mounting plate 202 to the upper frame 110 of the screed extension 108. For example, as shown in FIGS. 2A-2C, the pivot pin 250 may be attached to the mounting plate 202 within the channel between the lower frame 112 and the upper frame 110 of the screed extension 108. The pivot pin 250 may be configured to allow the mounting plate 202 to pivot around the pivot pin 250 when the angle of the mounting plate finger 224 within the angle of attack adjustment structure 216 is adjusted (e.g., by rotation of one or more of the set of angle of attack adjustment screws 218). For example, an adjustment of the mounting plate finger 224 to have a particular angle with respect to the axis associated with the angle of attack adjustment structure 216 may cause the mounting plate 202 to pivot on the pivot pin 250 and have the particular angle (or another angle) with respect to the axis associated with the angle of attack adjustment structure 216, which may cause (e.g., because the mounting plate 202 is attached to the upper frame 110 of screed extension via the pivot pin 250 and motion is driven to the lower frame 112 of the screed extension 108 via the guide pin 246) the lower frame 112 of the screed extension 108 to have a particular angle of attack (e.g., with respect to a work surface). Further description regarding adjustment of the angle of attack of the lower frame 112 of the screed extension 108 is provided herein in relation to FIGS. 5A-5B.

As further shown in FIGS. 2A-2D, the angle of attack adjustment structure 216 may comprise a set of bolts 252 that are configured to attach the attack adjustment structure 216 to the upper frame 110 of the screed extension 108.

As indicated above, FIGS. 2A-2D are provided as an example. Other examples may differ from what is described in connection with FIGS. 2A-2D.

Figure 3A:
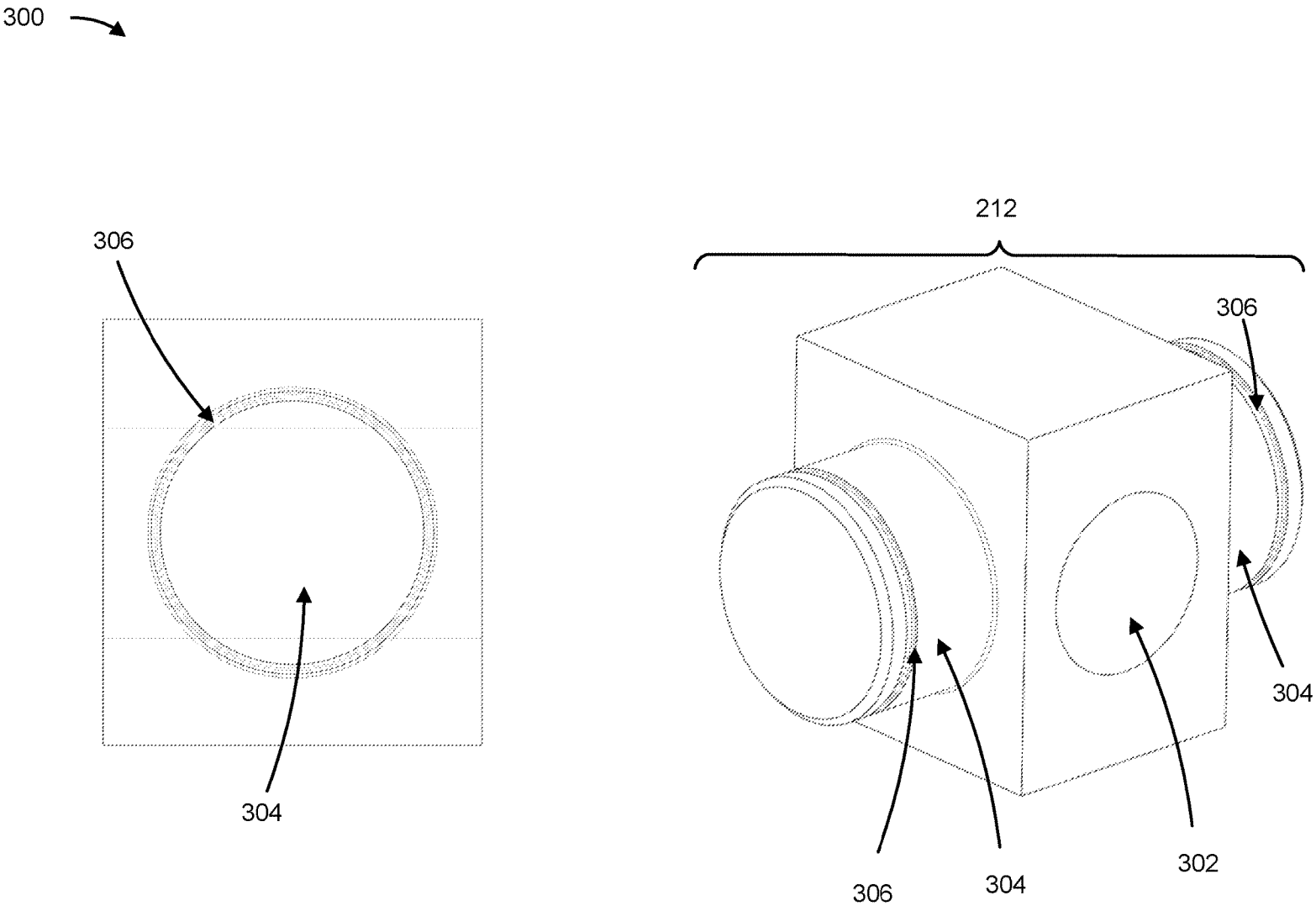
FIGS. 3A-3C are diagrams of example implementations of components of the linkage system described herein.
Figure 3B:
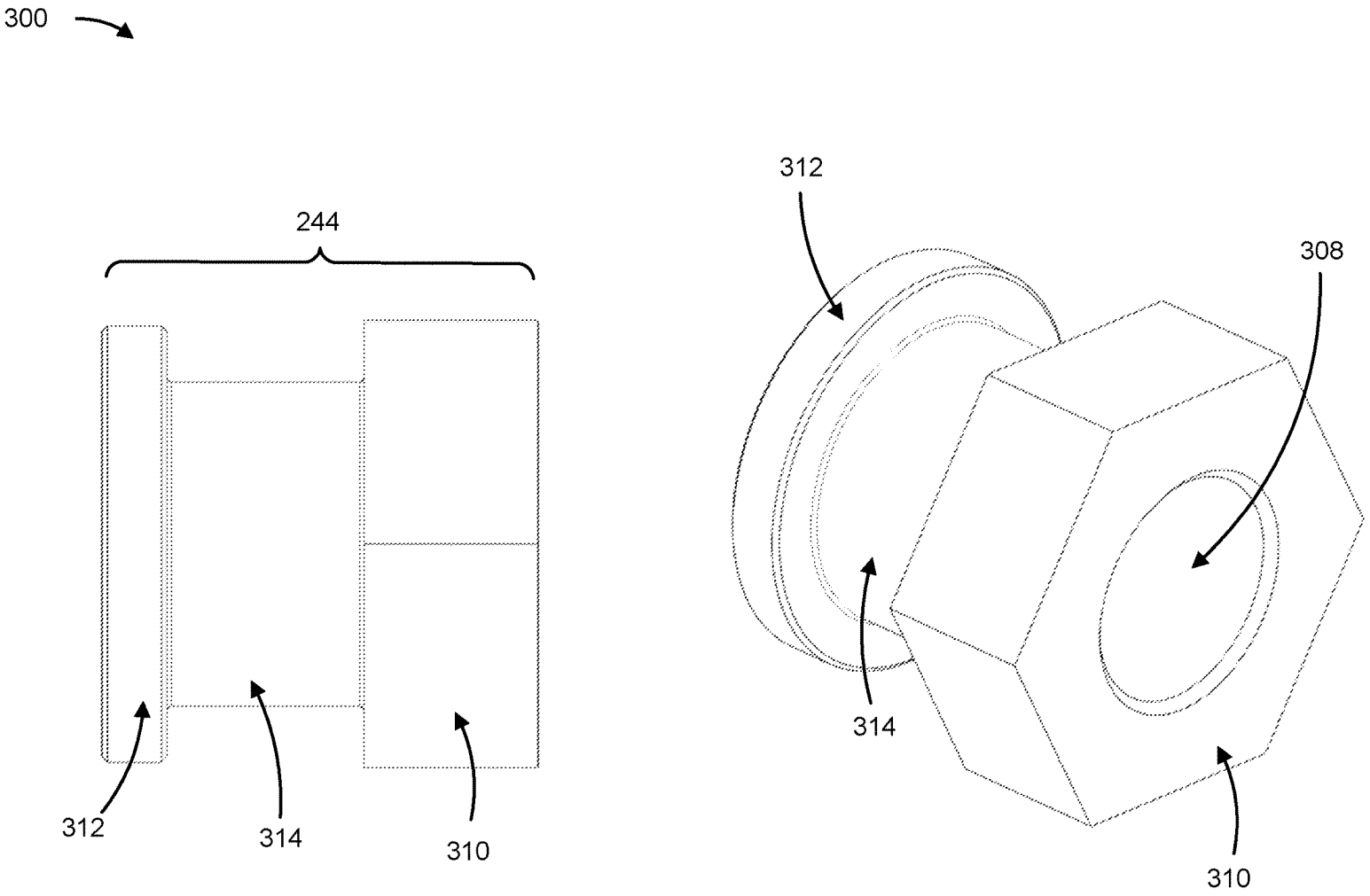
Figure 3C:
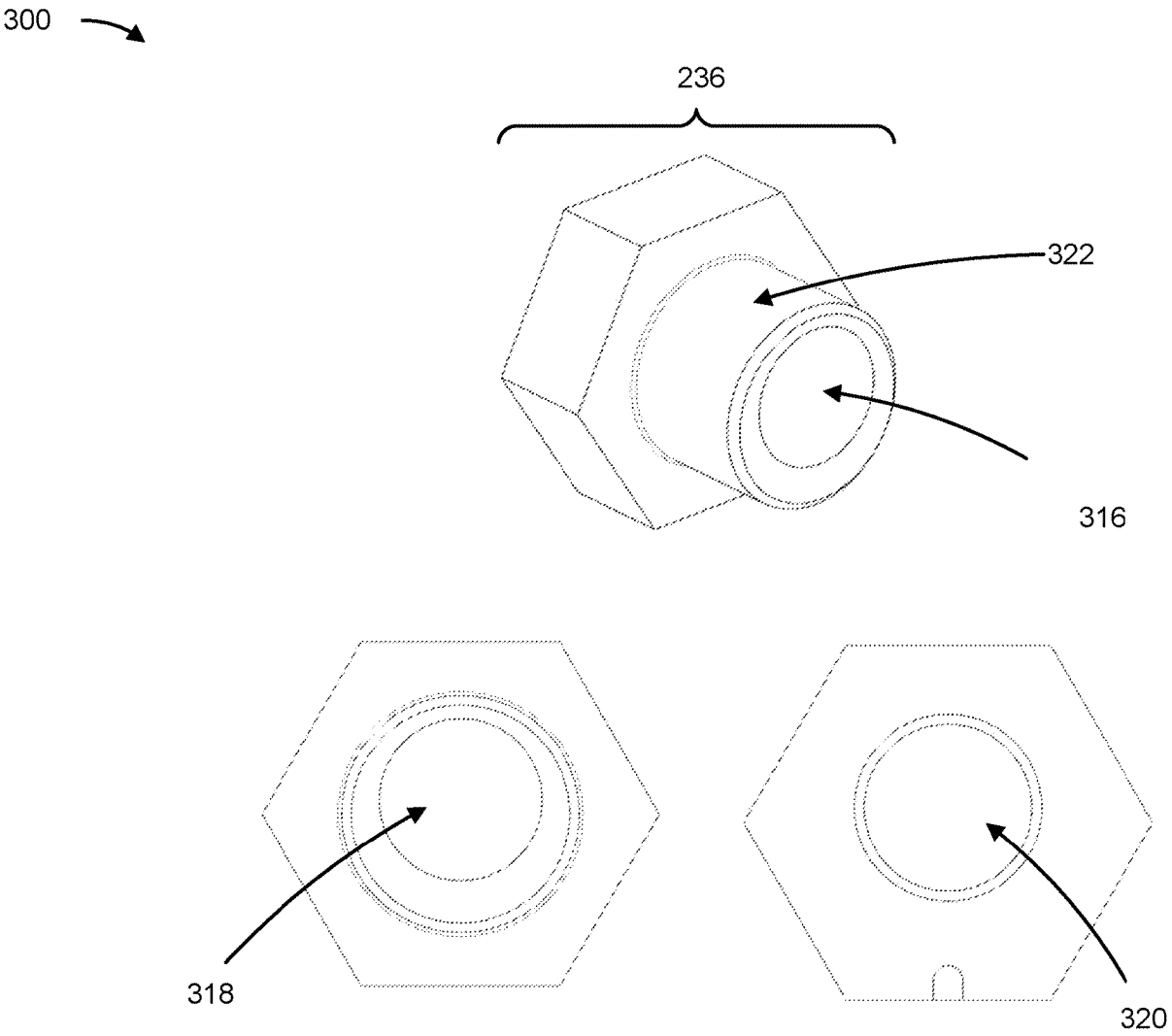

FIGS. 3A-3C are diagrams of example implementations 300 of components of the linkage system 200 described herein. FIG. 3A shows an example implementation of a slide block 212. FIG. 3B shows an example implementation of a height adjustment screw nut 244. FIG. 3C shows an example implementation of an eccentric adjuster 236.

As shown in FIG. 3A, the slide block 212 includes a shaft hole 302 that may be threaded in a particular orientation (e.g., in a clockwise orientation or a counter-clockwise orientation). A first surface of the slide block 212 may include a first opening of the shaft hole 302 and a second surface (e.g., that is opposite of the first surface) may include a second opening of the shaft hole 302. In this way, the shaft hole 302 may comprise a linear passthrough of the slide block 212 and may be configured to hold a portion of the height adjustment shaft 208 within the slide block 212 (e.g., as described herein in relation to FIGS. 2A-2D).

As further shown in FIG. 3A, a third surface of the slide block 212 may include a first slide block stem 304 with a first slide block stem groove 306 and a fourth surface may include a second slide block stem 304 with a second slide block stem groove 306. The first slide block stem 304 may insert into a first bore of an end of a linkage arm 214 and a first slide block retaining ring may insert into the first slide block stem groove 306 to prevent the first slide block stem 304 from dislodging from the first bore of the end of the linkage arm 214. Moreover, the second slide block stem 304 may insert into a second bore of the end of a linkage arm 214 and a second slide block retaining ring may insert into the second slide block stem groove 306 to prevent the second slide block stem 304 from dislodging from the second bore of the end of the linkage arm 214. In this way, the first slide block stem 304 and the first slide block stem groove 306 enable the slide block 212 to attach to the first bore of the linkage arm 214 and the second slide block stem 304 and the second slide block stem groove 306 enable the slide block 212 to attach to the second bore of the linkage arm 214.

As shown in FIG. 3B, the height adjustment screw nut 244 includes a shaft hole 308. A first surface of the height adjustment screw nut 244 may include a first opening of the shaft hole 308 and a second surface (e.g., that is opposite of the first surface) may include a second opening of the shaft hole 308. In this way, the shaft hole 308 may comprise a linear passthrough of the height adjustment screw nut 244 and may be configured to hold a portion of the height adjustment shaft 208 within the height adjustment screw nut 244 (e.g., as described herein in relation to FIGS. 2A-2D).

As further shown in FIG. 3B, the height adjustment screw nut 244 may include a front portion 310, a back portion 312, and a body portion 314. The back portion 312 may be configured to be disposed on a surface of the height adjustment structure 238 that has a hole for passing the height adjustment shaft 208 into the chamber of the linkage system 200 via the height adjustment jam nut 242. The height adjustment shaft 208 may insert into the shaft hole 308 via the front portion 310 and an assembler of the linkage system 200 may use a wrench or other tool to engage the height adjustment screw nut 244 to cause the height adjustment jam nut 242, the height adjustment shaft 208, and the height adjustment screw nut 244 to be locked in place. Accordingly, when locked in place, the height adjustment shaft 208 cannot move laterally (e.g., horizontally), but still can rotate (e.g., about the longitudinal axis of the height adjustment shaft 208).

As shown in FIG. 3C, the eccentric adjuster 236 includes a bolt hole 316. A first surface of the eccentric adjuster 236 may include a first opening 318 of the bolt hole 316 and a second surface (e.g., that is opposite of the first surface) may include a second opening 320 of the bolt hole 316. In this way, the bolt hole 316 may comprise a linear passthrough of the eccentric adjuster 236 and may be configured to hold a bolt 222, of the set of bolts 222, to attach the lower rail 206 to the mounting plate 202 (e.g., as described herein in relation to FIGS. 2A-2D).

As further shown in FIG. 3C, the first surface of the eccentric adjuster 236 may include an eccentric adjuster stem 322 that includes the first opening 318 of the bolt hole 316. The eccentric adjuster stem 322 may have a cylindrical shape with the first opening 318 formed in an end of the eccentric adjuster stem 322. The bolt hole 316 and the end of the eccentric adjuster stem 322 may not be concentric (e.g., a center point of the hole 316 may be different than a center point of the end of the eccentric adjuster stem 322).

The eccentric adjuster 236 may be configured to insert into a bore of the lower rail 206 and cause the lower rail 206 and the upper rail 204 to exert a clamping force on the set of slide blocks 212 within the channel formed by the lower rail 206 and the upper rail 204 (e.g., as described herein in relation to FIGS. 2A-2D).

As indicated above, FIGS. 3A-3C are provided as an example. Other examples may differ from what is described in connection with FIGS. 3A-3C.

Figure 4A:
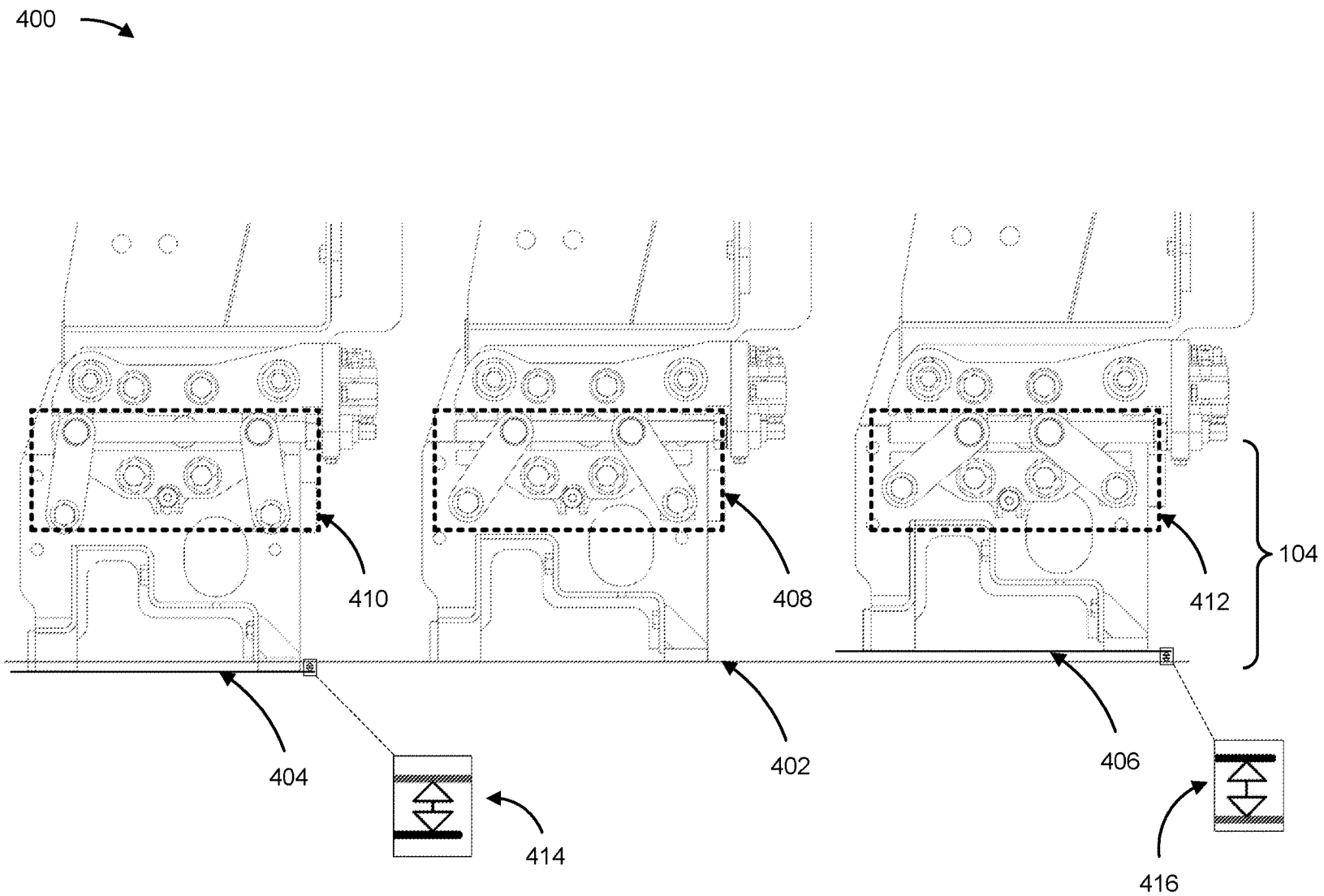
FIGS. 4A-4B are diagrams of example implementations related to adjustment of the height of a lower frame of the screed extension described herein.
Figure 4B:
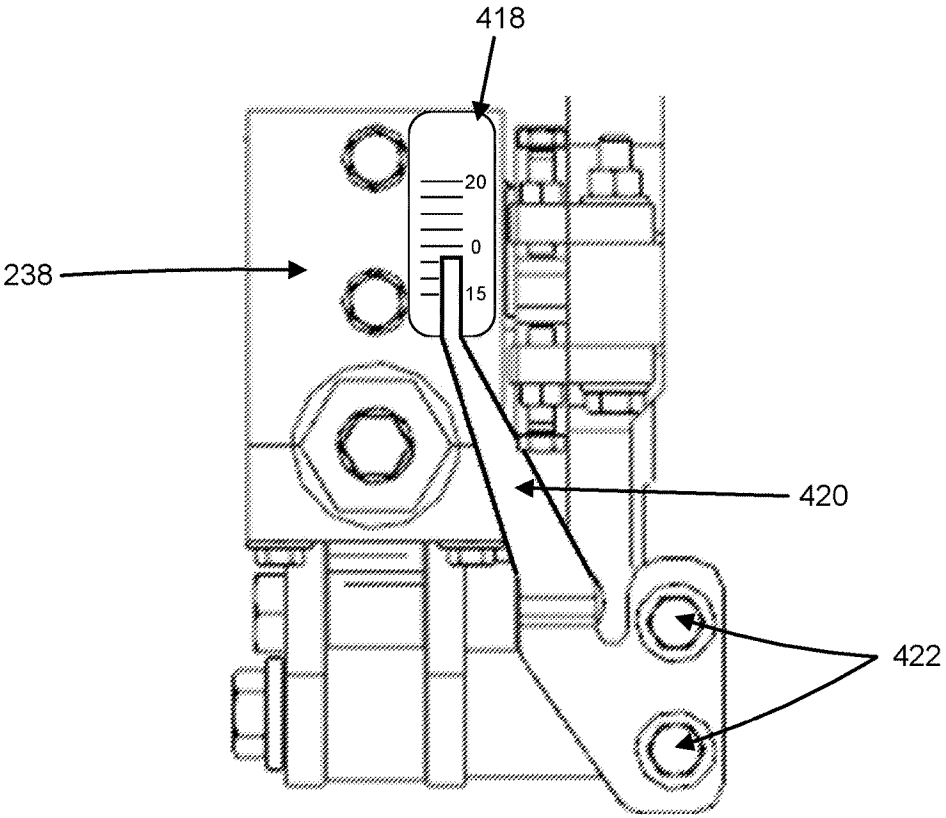

FIGS. 4A-4B are diagrams of example implementations 400 related to adjustment of the height of the lower frame 112 of the screed extension 108 (e.g., in relation to a work surface). FIG. 4A shows a height of the lower frame 112 at a nominal height 402, a low height 404, and a high height 406. The set of slide block 212 and the set of linkage arms 214 may be adjusted to be in a nominal position 408 to cause the lower frame 112 of the screed extension 108 to have the nominal height 402, may be adjusted to be in a low position 410 to cause the lower frame 112 of the screed extension 108 to have the low height 404, and may be adjusted to be in a high position 412 to cause the lower frame 112 of the screed extension 108 to have the high height 406. As further shown in FIG. 4A, a symmetrical angle of attachment of the set of linkage arms 214 to the set of slide blocks 212 is maintained in each position (e.g., an angle that a linkage arm 214, of the set of linkage arms 214, makes with a vertical axis is approximately symmetrical to an angle that another linkage arm 214, of the set of linkage arms 214, makes with the vertical axis). As further shown in FIG. 4A, there may exist a height difference 414 between the low height 404 and the nominal height 402 (e.g., 15 millimeters (mm)) and a height difference 416 between the high height 406 and the nominal height 402 (e.g., 20 mm). In this way, the height of the lower frame 112 of the screed extension 108 may be adjusted based on the position of the set of slide block 212 and the set of linkage arms 214.

As shown in FIG. 4B, a height scale 418 may be attached to the height adjustment structure 238 and a height indicator 420 may be attached to the lower frame 112 of the screed extension 108 by a set of bolts 422. The height indicator 420 and the height scale 418 may indicate how far above or below the lower frame 112 is from the nominal height 402. For example, when the lower frame 112 of the screed extension 108 has the low height 404 (e.g., 15 mm below the nominal height 402) the height indicator 420 and the height scale 418 may indicate the height difference 414. As another example, when the lower frame 112 of the screed extension 108 to has the high height 406 (e.g., 20 mm above the nominal height 402) the height indicator 420 and the height scale 418 may indicate the height difference 416.

As indicated above, FIGS. 4A-4B are provided as an example. Other examples may differ from what is described in connection with FIGS. 4A-4B.

Figure 5A:
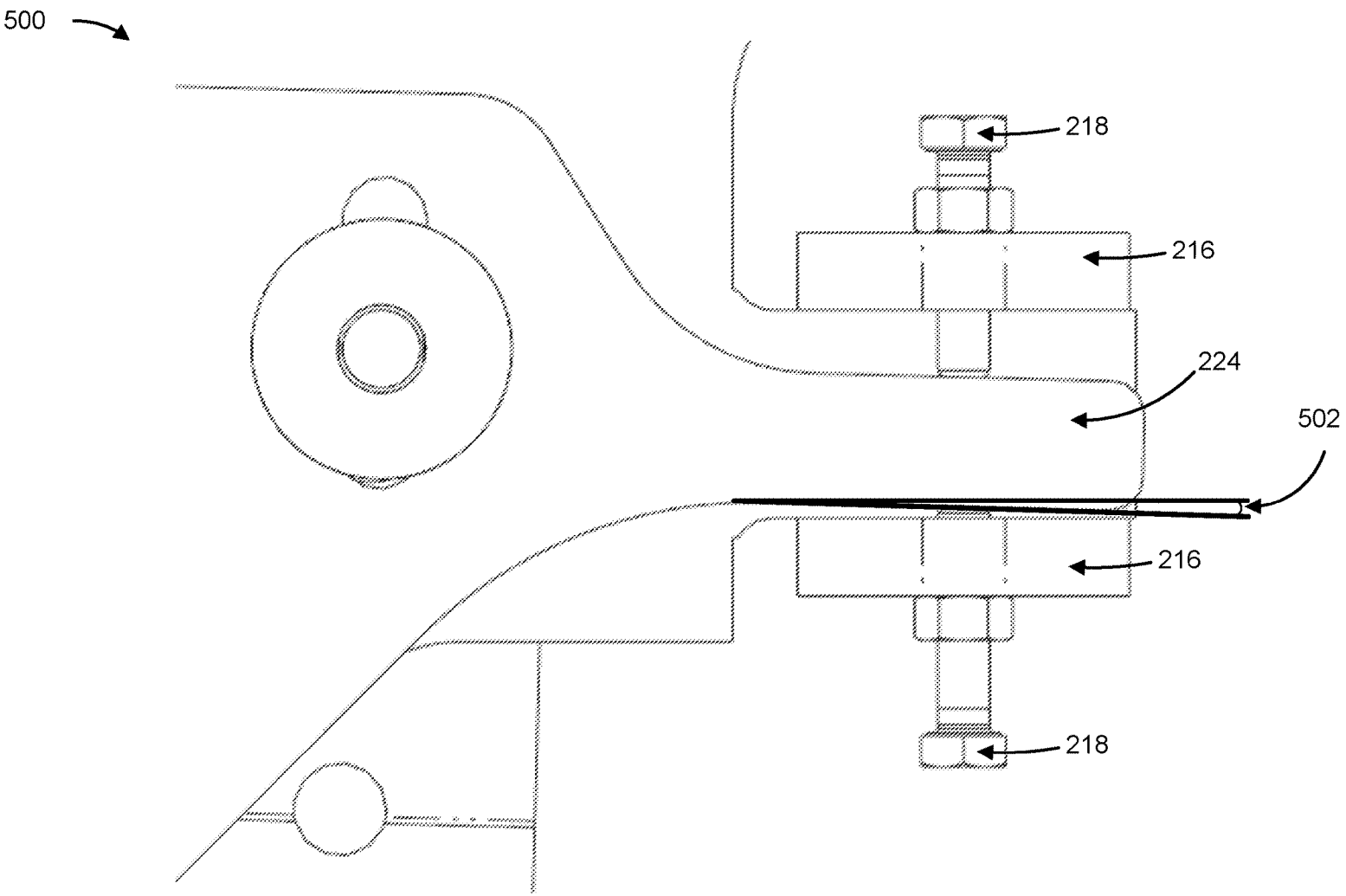
FIGS. 5A-5B are diagrams of example implementations related to an angle of attack of the lower frame of the screed extension described herein.
Figure 5B:
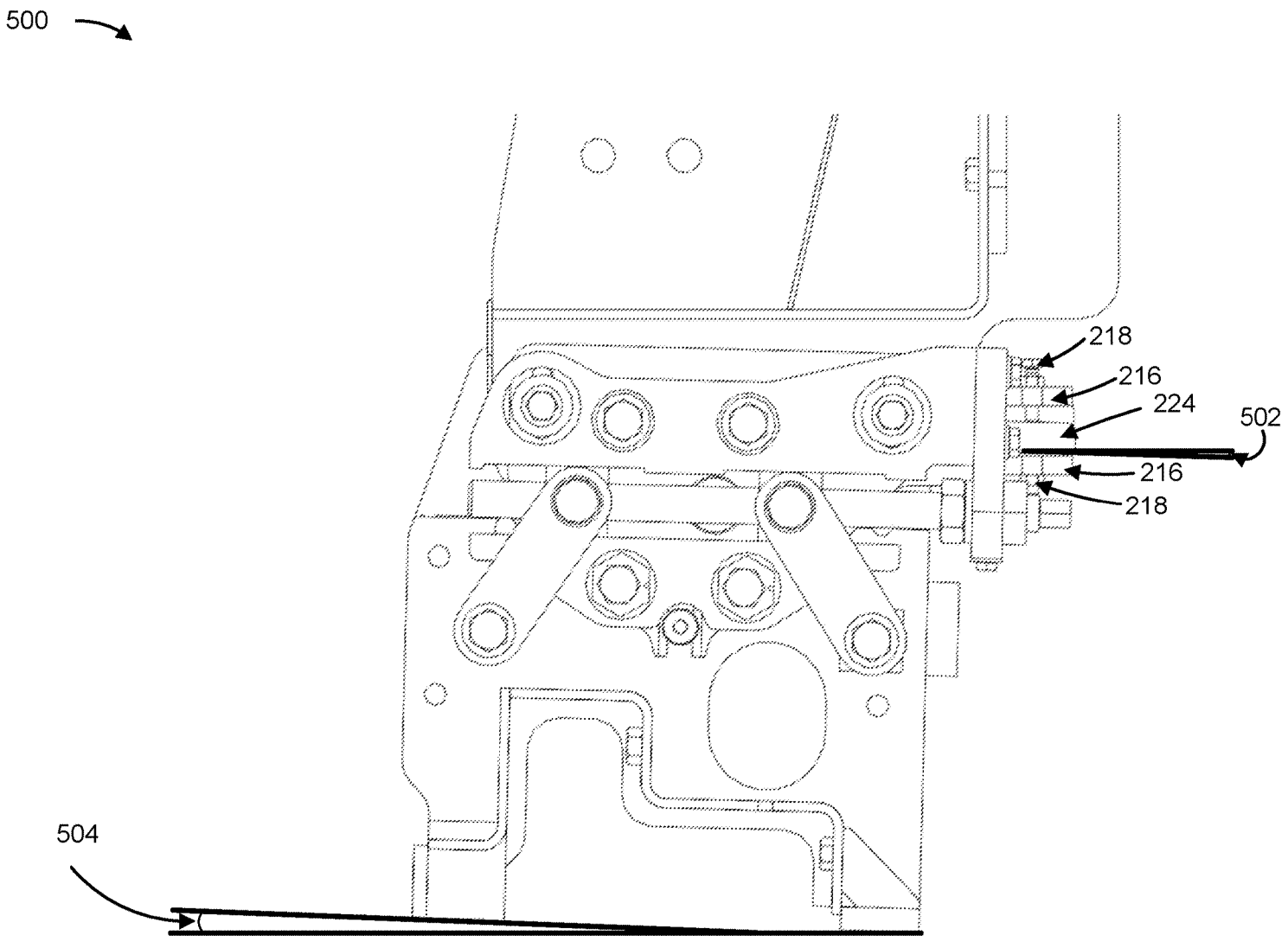

FIGS. 5A-5B are diagrams of example implementations 500 related to the angle of attack of the lower frame 112 of the screed extension 108 (e.g., in relation to a work surface). As shown in FIGS. 5A-5B, the angle of attack adjustment structure 216 and/or the set of angle of attack adjustment screws 218 may be configured to hold the mounting plate finger 224 at an angle 502 relative to an axis (e.g., a horizontal axis) associated with the angle of attack adjustment structure 216. This may cause the mounting plate 202 to have the angle 502 (or a similar angle) with respect to the axis associated with the angle of attack adjustment structure 216. As further shown in FIG. 5B, this may cause (e.g., because the mounting plate 202 is attached to the upper frame 110 of screed extension via the pivot pin 250 and motion is driven to the lower frame 112 of the screed extension 108 via the guide pin 246) the lower frame 112 of the screed extension 108 to have an angle of attack 504 (e.g., with respect to the work surface).

As indicated above, FIGS. 5A-5B are provided as an example. Other examples may differ from what is described in connection with FIGS. 5A-5B.

INDUSTRIAL APPLICABILITY

The disclosed linkage system may be used in any screed extension, or a primary screed, of a screed assembly of a paving machine. An operator of the paving machine may use a wrench, or other tool, to engage a height adjustment screw of the linkage system to cause adjustment of a height of a lower frame of the screed extension (e.g., in relation to a work surface). Further, the linkage system includes a guide pin configured to maintain an approximately symmetrical angle of attachment of a set of linkage arms that facilitate adjustment of the height of the lower frame of the screed extension. In this way, the linkage system provides a robust mechanism for changing the height of the lower frame of the screed extension that ensures that the height of the lower frame of the screed extension is uniformly adjusted over an operating life of the linkage system.

Moreover, the operator may use the wrench, or other tool, to engage a set of angle of attack adjustment screws to cause adjustment of an angle of attack of the lower frame of the screed extension (e.g., in relation to the work surface). The linkage system includes a pivot pin upon which a mounting plate of the linkage system pivots to facilitate adjustment of the angle of attack of the lower frame of the screed extension. In this way, the linkage system provides a robust mechanism for changing the angle of attack of the lower frame of the screed extension that is also separate from the mechanism for changing the height of the lower frame of the screed extension.

Accordingly, the linkage system may facilitate the screed extension, and the screed assembly that includes the screed extension, in laying a paving material mat with a uniform finish. This provides a greater quality paving material mat, which reduces a likelihood that the paving material mat will need to be repaired and/or or torn up and repaved. This may reduce unnecessary usage of the paving machine, the screed assembly, and/or the screed extension, which may extend a working life of the paving machine, the screed assembly, and/or the screed extension and/or reduce an amount of maintenance needed to maintain the paving machine, the screed assembly, and/or the screed extension.

What is claimed is:

1. A paving machine, comprising:

a linkage system that is included in a screed extension of a screed assembly of the paving machine, wherein the linkage system includes:

a mounting plate that includes a mounting plate finger;

an upper rail that is attached to the mounting plate;

a lower rail to the mounting plate;

a height adjustment shaft;

a set of slide blocks that are disposed in a channel between the upper rail and the lower rail, wherein each slide block, of the set of slide blocks, includes a shaft hole that holds a portion of the height adjustment shaft within the slide block;

a set of linkage arms, wherein each linkage arm, of the set of linkage arms, includes a first end that is attached to a corresponding slide block, of the set of slide blocks, and a second end that is attached to a lower frame of the screed extension;

an angle of attack adjustment structure that holds the mounting plate finger at an angle relative to an axis associated with the angle of attack adjustment structure; and a set of angle of attack adjustment screws, wherein:

the height adjustment shaft is configured to rotate about a longitudinal axis of the height adjustment shaft to adjust a position of the set of slide blocks within the channel, wherein adjusting the position of the set of slide blocks within the channel causes adjustment of a height of the lower frame of the screed extension; and each angle of attack adjustment screw, of the set of angle of attack adjustment screws, is configured to rotate about a longitudinal axis of the angle of attack adjustment screw to adjust the angle of the mounting plate finger within the angle of attack adjustment structure, wherein adjusting the angle of the mounting plate finger within the angle of attack adjustment structure causes adjustment of an angle of attack of the lower frame of the screed extension.

2. The paving machine of claim 1, wherein the linkage system further includes a pivot pin that attaches the mounting plate to an upper frame of the screed extension, wherein the pivot pin is configured to allow the mounting plate to pivot around the pivot pin when the angle of the mounting plate finger within the angle of attack adjustment structure is adjusted by the set of angle of attack adjustment screws.

3. The paving machine of claim 1, wherein the linkage system further includes a guide pin that attaches to the lower frame of the screed extension, wherein the guide pin is configured to maintain an approximately symmetrical angle of attachment of the set of linkage arms to the set of slide blocks when the position of the set of slide blocks is adjusted.

4. The paving machine of claim 1, wherein a particular slide block, of the set of slide blocks, includes:

a first surface that includes a first opening of the shaft hole of the particular slide block;

a second surface that includes a second opening of the shaft hole;

a third surface that includes a first slide block stem with a first slide block stem groove, wherein the first slide block stem and the first slide block stem groove attach the particular slide block to a first bore of a first end of a particular linkage arm, of the set of linkage arms; and a fourth surface that includes a second slide block stem with a second slide block stem groove, wherein the second slide block stem and the second slide block stem groove attach the particular slide block to a second bore of the first end of the particular linkage arm.

5. The paving machine of claim 1, wherein the linkage system further includes a height adjustment screw nut and a height adjustment jam nut that prevent lateral movement of the height adjustment shaft.

6. The paving machine of claim 1, wherein the linkage system further includes an eccentric adjuster, wherein the eccentric adjuster is configured to:

insert into a bore of the lower rail; and cause, when inserted into the bore of the lower rail, the lower rail to be placed in a position, relative to the upper rail, that causes the lower rail and the upper rail to exert a clamping force on the set of slide blocks within the channel between the upper rail and the lower rail.

7. The paving machine of claim 1, wherein the linkage system further includes:

a bolt that attaches the upper rail to the mounting plate;

a washer, through which the bolt is inserted, and that is disposed on a surface of the mounting plate; and a set of spring washers, through which the bolt is inserted, and that are disposed between the washer and a head of the bolt.

8. A screed extension, comprising:

a linkage system that includes:

a mounting plate that includes a mounting plate finger;

an upper rail that is attached to the mounting plate;

a lower rail that is attached to the mounting plate;

a height adjustment shaft;

a set of slide blocks that are disposed in a channel between the upper rail and the lower rail, wherein each slide block, of the set of slide blocks, includes a shaft hole that holds a portion of the height adjustment shaft within the slide block;

a set of linkage arms, wherein each linkage arm, of the set of linkage arms, includes a first end that is attached to a corresponding slide block, of the set of slide blocks, and a second end that is attached to a lower frame of the screed extension;

an angle of attack adjustment structure that holds the mounting plate finger at an angle relative to an axis associated with the angle of attack adjustment structure; and a set of angle of attack adjustment screws.

9. The screed extension of claim 8, wherein:

the height adjustment shaft is configured to rotate about a longitudinal axis of the height adjustment shaft to adjust a position of the set of slide blocks within the channel, wherein adjusting the position of the set of slide blocks within the channel causes adjustment of a height of the lower frame of the screed extension.

10. The screed extension of claim 9, wherein the linkage system further includes a guide pin that attaches to the lower frame of the screed extension, wherein the guide pin is configured to maintain an approximately symmetrical angle of attachment of the set of linkage arms to the set of slide blocks when the position of the set of slide blocks is adjusted.

11. The screed extension of claim 8, wherein:

each angle of attack adjustment screw, of the set of angle of attack adjustment screws, is configured to rotate about a longitudinal axis of the angle of attack adjustment screw to adjust the angle of the mounting plate finger within the angle of attack adjustment structure, wherein adjusting the angle of the mounting plate finger within the angle of attack adjustment structure causes adjustment of an angle of attack of the lower frame of the screed extension.

12. The screed extension of claim 11, wherein the linkage system further includes a pivot pin that attaches the mounting plate to an upper frame of the screed extension, wherein the pivot pin is configured to allow the mounting plate to pivot around the pivot pin when the angle of the mounting plate finger within the angle of attack adjustment structure is adjusted by the set of angle of attack adjustment screws, wherein the mounting plate pivoting around the pivot pin causes the adjustment of the angle of attack of the lower frame of the screed extension.

13. The screed extension of claim 8, wherein:

the height adjustment shaft is threaded in a particular orientation;

a first slide block, of the set of slide blocks, includes a first shaft hole that is threaded in the particular orientation; and a second slide block, of the set of slide block, includes a second shaft hole that is threaded in an opposite orientation of the particular orientation, wherein the height adjustment shaft is configured to cause, when rotated about a longitudinal axis of the height adjustment shaft, the first slide block to move in a first direction within the channel and cause the second slide block to move in a second direction within the channel, wherein the second direction is approximately opposite of the first direction.

14. The screed extension of claim 8, wherein the linkage system further includes a height adjustment screw nut that holds the height adjustment shaft in place in the linkage system.

15. The screed extension of claim 8, wherein a particular slide block, of the set of slide blocks, includes:

a first slide block stem with a first slide block stem groove, wherein the first slide block stem and the first slide block stem groove attach the particular slide block to a first bore of a first end of a particular linkage arm, of the set of linkage arms; and a second slide block stem with a second slide block stem groove, wherein the second slide block stem and the second slide block stem groove attach the particular slide block to a second bore of the first end of the particular linkage arm.

16. The screed extension of claim 8, wherein the linkage system further includes an eccentric adjuster that is configured to cause the lower rail to be placed in a position, relative to the upper rail, that causes the lower rail and the upper rail to exert a clamping force on the set of slide blocks within the channel between the upper rail and the lower rail.

17. The screed extension of claim 8, wherein the linkage system further includes:

a set of spring washers, through which a bolt that attaches the mounting plate to the lower frame of the screed extension is inserted, wherein the set of spring washers are disposed between a surface of the mounting plate and a head of the bolt.

18. A linkage system, comprising:

a mounting plate that includes a mounting plate finger;

an upper rail that is configured to the mounting plate;

a lower rail that is configured to attach to the mounting plate;

a height adjustment shaft;

a set of slide blocks that are configured to be disposed in a channel between the upper rail and the lower rail, wherein each slide block, of the set of slide blocks, includes a shaft hole that is configured to hold a portion of the height adjustment shaft within the slide block;

a set of linkage arms, wherein each linkage arm, of the set of linkage arms, includes a first end that is configured to attach to a corresponding slide block, of the set of slide blocks, and a second end that is configured to attach to a lower frame of a screed extension;

an angle of attack adjustment structure that is configured to hold the mounting plate finger at an angle relative to an axis associated with the angle of attack adjustment structure; and a set of angle of attack adjustment screws.

19. The linkage system of claim 18, wherein:

the height adjustment shaft is configured to rotate about a longitudinal axis of the height adjustment shaft to adjust a position of the set of slide blocks within the channel.

20. The linkage system of claim 18, wherein:

each angle of attack adjustment screw, of the set of angle of attack adjustment screws, is configured to rotate about a longitudinal axis of the angle of attack adjustment screw to adjust the angle of the mounting plate finger within the angle of attack adjustment structure.

* * * * *